US008491241B2

(12) United States Patent
Glatz et al.

(10) Patent No.: US 8,491,241 B2
(45) Date of Patent: Jul. 23, 2013

(54) DEVICE FOR REDUCING LOADS ON LATCHES AND LOADS ON CARGO CONTAINERS

(75) Inventors: Dietmar Glatz, Leipzig (DE); Markus Kaulbars, Paderborn (DE); Ulrich Meier-Noe, Paderborn (DE); Achim Merklinger, Kieselbronn (DE); Ludger Merz, Hamburg (DE)

(73) Assignee: Airbus Operations GmbH (DE)

( * ) Notice: Subject to any disclaimer, the term of this patent is extended or adjusted under 35 U.S.C. 154(b) by 0 days.

(21) Appl. No.: 13/203,536

(22) PCT Filed: Feb. 23, 2010

(86) PCT No.: PCT/EP2010/052256

§ 371 (c)(1),
(2), (4) Date: Nov. 4, 2011

(87) PCT Pub. No.: WO2010/097378

PCT Pub. Date: Sep. 2, 2010

(65) Prior Publication Data

US 2012/0037619 A1 Feb. 16, 2012

Related U.S. Application Data

(60) Provisional application No. 61/155,987, filed on Feb. 27, 2009.

(30) Foreign Application Priority Data

Feb. 27, 2009 (DE) ..... 10 2009 010 860

(51) Int. Cl.
*B60P 7/08* (2006.01)

(52) U.S. Cl.
USPC ..... 410/80

(58) Field of Classification Search
USPC ..... 410/80, 87
See application file for complete search history.

(56) References Cited

U.S. PATENT DOCUMENTS

| | | | | |
|---|---|---|---|---|
| 3,090,331 A | | 5/1963 | Mccann | |
| 3,119,357 A | * | 1/1964 | Jerry et al. | 108/57.12 |
| 3,330,521 A | * | 7/1967 | Whirlein | 220/632 |
| 3,598,273 A | | 8/1971 | Rau et al. | |
| 3,658,205 A | | 4/1972 | Kassravi | |
| 4,079,907 A | * | 3/1978 | Mykleby | 410/46 |

(Continued)

FOREIGN PATENT DOCUMENTS

| | | |
|---|---|---|
| DE | 2719925 A1 | 11/1977 |
| DE | 10218995 A1 | 11/2003 |

(Continued)

*Primary Examiner* — H Gutman
(74) *Attorney, Agent, or Firm* — Lerner, David, Littenberg, Krumholz & Mentlik, LLP

(57) ABSTRACT

The invention relates to a device for reducing latch loads during the process of loading and flying air cargo containers inside cargo holds of aircraft. The device exhibits a floor plate of a cargo unit of a transport means, an edge profile, a rail bumper as well as a first damping unit. The first damping unit is situated between the edge profile and the floor plate, or between the edge profile and the rail bumper of the cargo unit. The first damping unit is designed for damping a movement by the cargo unit in a direction of movement of the cargo unit so as to reduce the loads placed on the cargo unit.

15 Claims, 9 Drawing Sheets

U.S. PATENT DOCUMENTS

| | | | | |
|---|---|---|---|---|
| 4,095,687 | A * | 6/1978 | Shoiket | 198/345.3 |
| 4,271,975 | A | 6/1981 | Ketner et al. | |
| 4,325,488 | A | 4/1982 | Ketner | |
| 4,758,299 | A | 7/1988 | Burke | |
| 4,795,047 | A | 1/1989 | Dunwoodie | |
| 5,080,950 | A | 1/1992 | Burke | |
| 5,398,831 | A | 3/1995 | Avramides et al. | |
| 5,970,886 | A * | 10/1999 | Knio | 108/57.12 |
| 6,112,931 | A | 9/2000 | Booth et al. | |
| 6,299,009 | B1 | 10/2001 | Ryziuk et al. | |
| 6,418,862 | B1 * | 7/2002 | Heil | 108/57.12 |
| 6,988,781 | B2 | 1/2006 | Dang et al. | |
| 7,263,855 | B2 | 9/2007 | Meyer et al. | |
| 7,311,216 | B2 | 12/2007 | Donnelly et al. | |
| 2002/0007602 | A1 | 1/2002 | Corcoran | |
| 2003/0057663 | A1 | 3/2003 | Trescott | |
| 2004/0112907 | A1 | 6/2004 | Donnelly et al. | |
| 2004/0123783 | A1 | 7/2004 | Dang et al. | |
| 2007/0253790 | A1 | 11/2007 | Boggenstall et al. | |
| 2010/0040427 | A1 | 2/2010 | Merz | |

FOREIGN PATENT DOCUMENTS

| | | | |
|---|---|---|---|
| DE | 102004039666 | A1 | 3/2006 |
| DE | 102005061957 | A1 | 7/2007 |
| GB | 1578863 | A | 11/1980 |
| JP | 06048480 | A | 2/1994 |
| WO | 2007071419 | A2 | 6/2007 |

* cited by examiner

DEVICE FOR REDUCING LOADS ON LATCHES AND LOADS ON CARGO CONTAINERS

CROSS-REFERENCE TO RELATED APPLICATIONS

This application is a national phase entry under 35 U.S.C. §371 of International Application No. PCT/EP2010/052256, filed Feb. 23, 2010, published in German, which claims the benefit of the filing date of German Patent Application No. 10 2009 010 860.2 filed Feb. 27, 2009, and of U.S. Provisional Patent Application No. 61/155,987 filed Feb. 27, 2009, the entire disclosures of which are hereby incorporated herein by reference.

FIELD OF THE INVENTION

The invention relates to the reduction of loads between cargo containers and latches in cargo holds. In particular, the invention relates to a device for reducing loads on moved cargo units inside a cargo hold of a transport means. In addition, the invention relates to a cargo container with a device for reducing loads, a transport means with a cargo container, as well as a method for reducing loads on a moved load unit inside the cargo hold of a transport means.

BACKGROUND OF THE INVENTION

Cargo and registered luggage in large-capacity aircraft is transported by means of air cargo containers and pallets, so-called unit load devices (hereinafter referred to as ULD). Manual loading is often made inefficient by the high loading capacity and objective of short idle times for large-capacity aircraft.

During the loading process, ULD's are generally fixed in their final position at the edge rails of their floor plate by way of latches inside the cargo holds of aircraft. Positioning here takes place by way of roller mats (ball mats, ball strips, ball transfer units) or roller tracks inside the cargo hold of the aircraft.

In addition to manual positioning, so-called power drive units (PDU) can be used for electrical positioning. These consist of an electrical drive, a gearbox, as well as a powered, rubber-coated roller, which is mounted in a roller track.

During the loading process, the edge rails of the ULD are moved up to the latches inside the cargo hold. The latter here form a stop for the edge rails. Once the final position of the ULD has been reached, the latches are clamped on the upper side of the edge rails of the ULD. As a result, the ULD is fixed in place, and now only allows a slight shifting.

The edge rails of a ULD generally consist of stiff metal profiles, which rigidly encase the floor plate of the cargo container on all sides. Rivet joints or other conventional bonding techniques are generally used to bond the floor plate with the edge rails.

In the aforementioned systems, critical dynamic loads (forces and moments) can be reached during loading processes and flight operations, which can lead to significant damage to the latches and entire floor structure inside the cargo holds of aircraft. For example, the high dynamic loads can stem from the stiff and coupled structure of a floor plate, a container jacket and edge rails of a ULD.

DE 10 2004 039 666 A1 and US 2007/0253790 A1 show a device for latching objects, in particular in an aircraft.

DE 10 2005 061 957 A1 shows a latching device for securing useful payload containers, in which a gap can be introduced between the payload container and latching device by means of a locking element.

SUMMARY OF THE INVENTION

It may be an object of the invention to provide for a device for flexibly using cargo units and preserving the material.

Indicated according the features in the independent claims are a device for reducing loads on a moved cargo unit inside a cargo hold of a transport means, a cargo container for an aircraft with the device, a transport means with a cargo hold and the cargo container, as well as a method for reducing loads on a moved cargo unit inside a cargo hold of a transport means. Further developments of the invention are embodied in the dependent claims.

One exemplary embodiment of the invention indicates a device for reducing loads on a moved cargo unit and a latch inside a cargo hold of a transport means with a floor plate of the cargo unit, an edge profile, a rail bumper and a first damping unit. The first damping unit is arranged between the edge profile and floor plate, or between the edge profile and rail bumper, wherein the first damping unit is designed to dampen a movement by the cargo unit in a direction of movement of the cargo unit to reduce the loads on the cargo unit.

This type of device makes it possible to reduce the loads on cargo containers and latches inside the cargo hold by modifying the floor construction of ULD consisting of edge rails and floor plate in such a way that only comparably low dynamic loads can still be transmitted by the latter in the shifting plane of the ULD. The modification can here involve a reduction in stiffness, an elevation in damping, as well as a reduction in mass of the floor construction in the shifting plane, as well as a combination of the aforementioned modifications.

This type of device allows a relative movement to take place between the rail bumper (rail bumper) and remaining edge profile (edge rail) when loads, such as forces and moments, arise in the shifting plane of the ULD, thereby making it possible to dampen the movement of the cargo unit.

This type of device further permits a significant reduction in loads on the latches, for example those which can be used inside the cargo holds of aircraft to secure air cargo containers. For example, this enables a tangible reduction in damage to the latches and floors of the cargo holds, as well as to the cargo containers, which can end up increasing customer satisfaction and lengthening the life of air cargo containers.

In this type of device for reducing loads on a moved cargo unit inside a cargo hold of a transport means, the floor plate, edge profile and rail bumper can be made out of steel or aluminium, as well as polymer components or composites (composites). The damping unit can consist of elastomers or any elastic material.

This type of device for reducing loads on a moved cargo unit inside a cargo hold makes it possible to reduce the loads by decreasing the stiffness or improving the damping characteristics of an area of the cargo unit. In addition, decoupling the edge profile and floor plate can allow a relative movement in a direction of movement of the cargo unit, thereby reducing the loads and decreasing the number of structural damages to the cargo unit and the latches for fixing the cargo unit in place.

In another exemplary embodiment of the invention, the edge profile and rail bumper are designed as separate assemblies.

At least the edge profile and rail bumper can move relative to each other, wherein the damping unit decelerates the relative movement between the rail bumper and edge profile.

In another exemplary embodiment of the invention, the device comprises a second damping unit, wherein the first damping unit is situated between the rail bumper and a first side of the edge profile, wherein the second rail bumper is situated between the rail bumper and a second side of the edge profile, and the first side is arranged perpendicular to the second side.

In another exemplary embodiment of the invention, the first damping unit is designed as an elastic spring element.

In another exemplary embodiment of the invention, the second damping unit is designed as an elastic spring element.

In another exemplary embodiment of the invention, the first damping unit is designed as an elastically deformable rivet joint with an elastically deformable bushing.

In another exemplary embodiment of the invention, the second damping unit is designed as an elastically deformable rivet joint with an elastically deformable bushing.

In another exemplary embodiment of the invention, the elastically deformable bushing is made out of an elastomer.

In another exemplary embodiment of the invention, the edge profile comprises a groove designed to float mount the floor plate in the groove, wherein the first damping unit is situated in the groove of the edge profile. In other words, an edge area of the floor plate is bordered and guided by the groove.

In another exemplary embodiment of the invention, the first damping unit is integrated into the rail bumper of the cargo unit.

In another exemplary embodiment of the invention, the first damping unit is designed as an elastic lip, wherein the elastic lip joins the rail bumper with the edge profile.

In another exemplary embodiment of the invention, the second damping unit is designed as an elastic lip, which is situated between the edge profile and floor plate of the cargo unit.

Another exemplary embodiment of the invention indicates a cargo container for an aircraft with a lateral wall, as well as a device according to one of the preceding exemplary embodiments of the invention. The edge profile is designed for joining the lateral wall with the floor plate.

Another exemplary embodiment of the invention indicates a transport means with a cargo hold, as well as a cargo container and a latch for fixing the cargo container in place inside the cargo hold.

Another exemplary embodiment of the invention indicates a method for reducing loads on a moved cargo unit inside a cargo hold of a transport means, with a first step for arranging a damping unit between an edge profile and floor plate of the cargo unit, or between the edge profile and rail bumper of the cargo unit, and a second step for damping a movement by the cargo unit in a direction of movement of the cargo unit so as to reduce the loads placed on the cargo unit by means of a damping unit.

In another exemplary embodiment of the invention, the method additionally involves reducing the loads on the moved cargo unit during the process of loading the cargo unit or while transporting the cargo unit inside the cargo hold of the transport means or in flight.

The individual features of the various exemplary embodiments can also be combined with each other, which can also lead in part to advantageous effects that exceed the sum total of individual effects, even if these are not expressly described.

It must be noted in particular that the features described here and below relative to the device can also be implemented in the cargo container, the transport means and the method, and vice versa.

These and other aspects of the invention will be explained and clarified through reference to the exemplary embodiments described below.

DETAILED DESCRIPTION OF EXEMPLARY EMBODIMENTS

Exemplary embodiments of the invention are described below with reference to the attached drawings.

The depictions on the figures are diagrammatic and not to scale. The same reference numbers are used in the following figure descriptions for identical or similar elements.

Figure 1B:
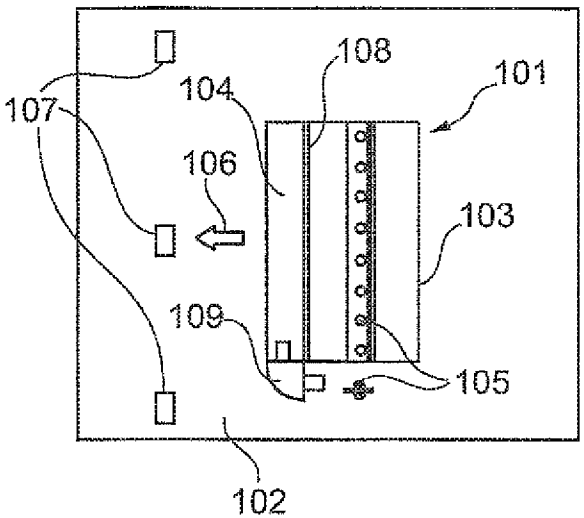
Fig.1b (PRIOR ART)
FIG. 1*b* shows the device on FIG. 1*a* as viewed from above.
Figure 1A:
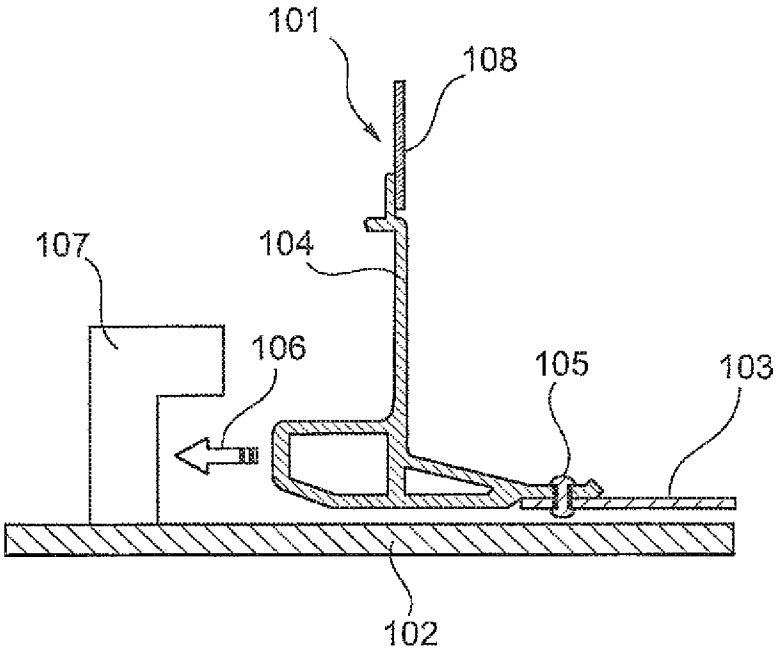
Fig.1a (PRIOR ART)
FIG. 1*a* shows a side view of a diagrammatic depiction of a device for fixing a cargo unit in place inside a cargo hold.

FIG. 1*a* shows a cargo unit 101 with a lateral wall 108, which is joined via an edge profile 104 with a floor plate 103, which is riveted to the edge profile 104 by a rivet 105. The cargo unit 101 moves in a direction of movement 106 inside a cargo hold 102 toward a latch 107, which is designed for fixing the cargo unit 101 in place inside the cargo hold 102.

FIG. 1*b* shows the cargo unit 101, the cargo hold 102, as well as three latches 107 on FIG. 1*a* as viewed from above. Several rivets 105 can couple four edge profiles 104 of the cargo unit 101 with the floor plate 103. In this case, four corner units 109 that interconnect the edge profiles 104 act in conjunction with the floor plate 103 as a single mass with the same stiffness. As a consequence, exposure to a load results in one high load impact as opposed to several smaller load impacts.

Figure 2B:
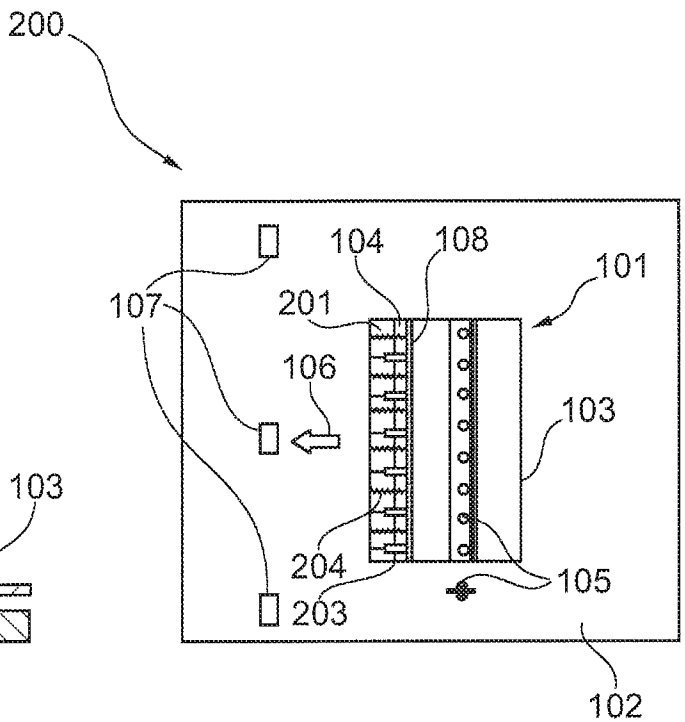
FIG. 2*b* shows the device on FIG. 2*a* as viewed from above.
Figure 2A:
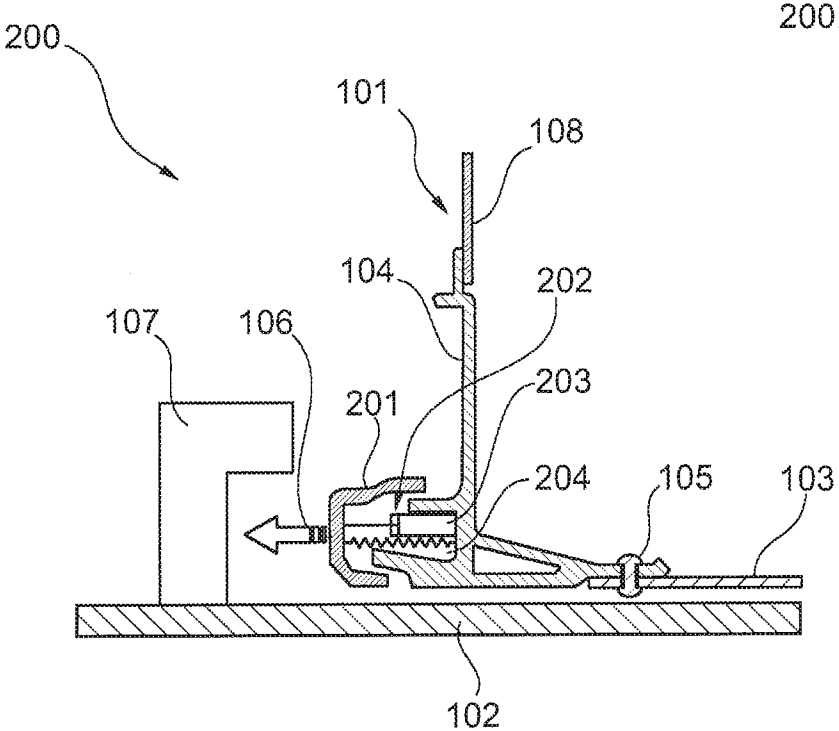
FIG. 2*a* shows a side view of a diagrammatic depiction of a device for reducing loads on a moved cargo unit inside a cargo hold of a transport means according to an exemplary embodiment of the invention.

FIG. 2*a* shows a device 200 for reducing loads on a moved cargo unit 101 inside a cargo hold 102 of a transport means with a floor plate 103, which is riveted to an edge profile 104 by a rivet 105. The edge profile 104 has a lateral wall 108 in the vertical direction.

The cargo unit 101 moves in a direction of movement 106 toward a latch 107, which is secured to the cargo hold 102 of the transport means, and designed to fix the cargo unit 101 in place inside the cargo hold 102.

A damping unit 202 encompasses a damper 203 and spring element 204, and in the direction of movement 106 is arranged between the edge profile 104 and a rail bumper 201, which is designed to bump up against the latch 107. The damping unit 202 is here designed to dampen a movement by the cargo unit 101 in the direction of movement 106 of the cargo unit 101 to reduce the loads on the cargo unit 101 and latch 107.

FIG. 2*b* shows the device 200 on FIG. 2*a* as viewed from above. The lightweight rail bumper 201 is coupled with the edge profile 104 via the spring 204 and damper 203, which are arranged parallel to each other. The spring 204 here has the job of moving the rail bumper 201 into an initial position or holding it there. The excess length of the rail bumper 201 secures the load removal in a vertical direction, and prevents contaminants or foreign bodies from penetrating. Smaller load impacts can arise in this device 200 owing to separated masses.

Figure 3B:
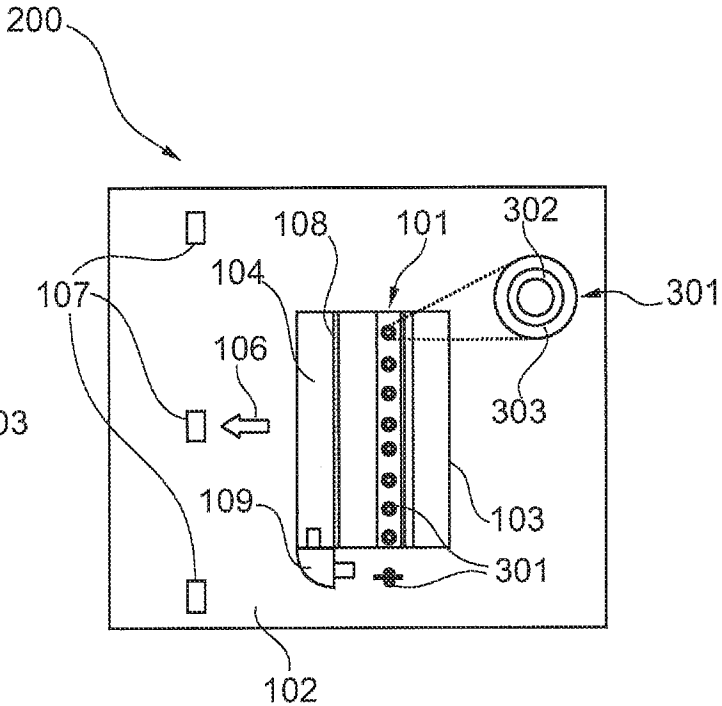
FIG. 3*b* shows the device on FIG. 3*a* as viewed from above.
Figure 3A:
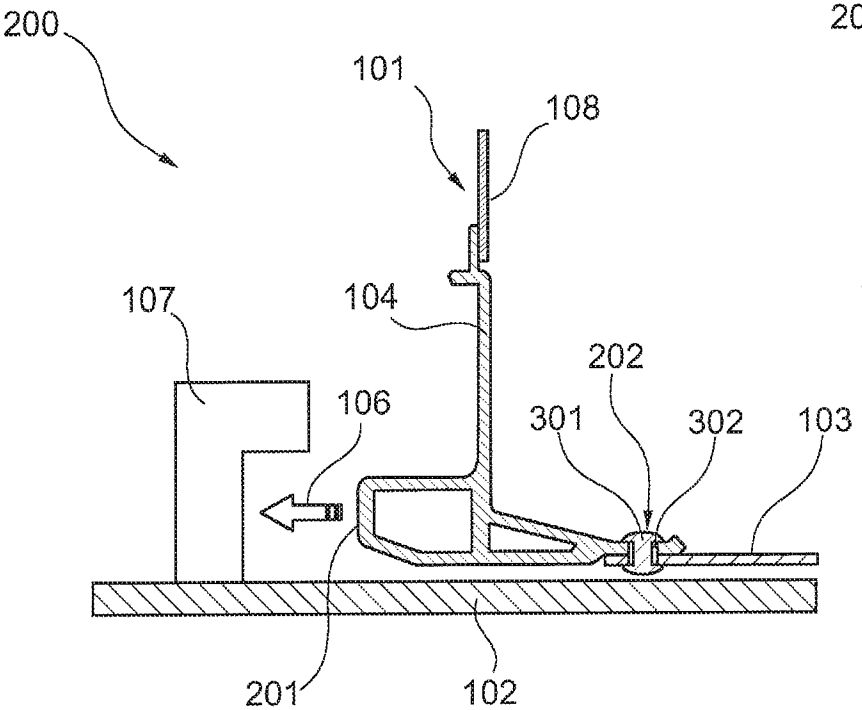
FIG. 3*a* shows a side view of another diagrammatic depiction of a device for reducing loads on a moved cargo unit inside a cargo hold of a transport means according to an exemplary embodiment of the invention.

FIG. 3*a* shows a device 200 for reducing loads on a moved cargo unit 101 inside a cargo hold 102 of a transport means with a floor plate 103, which is secured to an edge profile 104 by means of an elastically deformable rivet joint 301 with an elastically deformable bushing 302. A lateral wall 108 is attached to the edge profile 104 in a vertical direction. The cargo unit 101 here moves toward a latch 107, which is secured to the cargo hold 102 of the transport means for fixing the cargo unit 101 in place. The edge profile 104 forms a rail bumper 201 in the direction of the latch 107. A corner unit 109 is designed to join two respective edge profiles 102 of the four edge profiles 102 of the cargo unit 101.

The elastically deformable rivet joint 301 with the elastically deformable bushing 302 forms a damping unit 202 designed to dampen a movement by the cargo unit 101 in a direction of movement 106 of the cargo unit 101 in order to reduce the loads placed on the cargo unit 101 and latch 107.

FIG. 3*b* shows the device 200 on FIG. 3*a* as viewed from above. An elastomer damping unit 202 for the rivet 301 decouples the loads on the edge profile 104 from the loads on the floor plate 103 and the other edge profiles 104 (the elastomer provides a spring directional coupling and damping). Since the loads placed on the cargo unit 102 are individual loads (no heat generated by long-term oscillation), rubber can be used as the damping material.

Figure 4B:
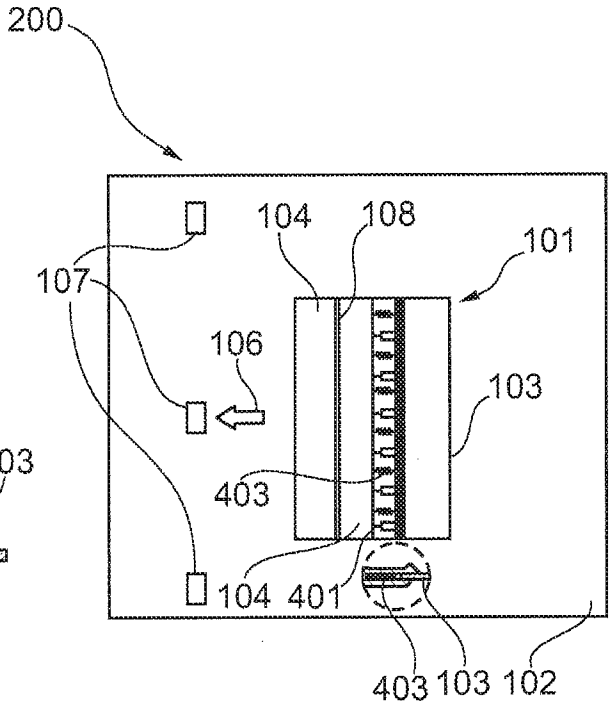
FIG. 4*b* shows the device on FIG. 4*a* as viewed from above.
Figure 4A:
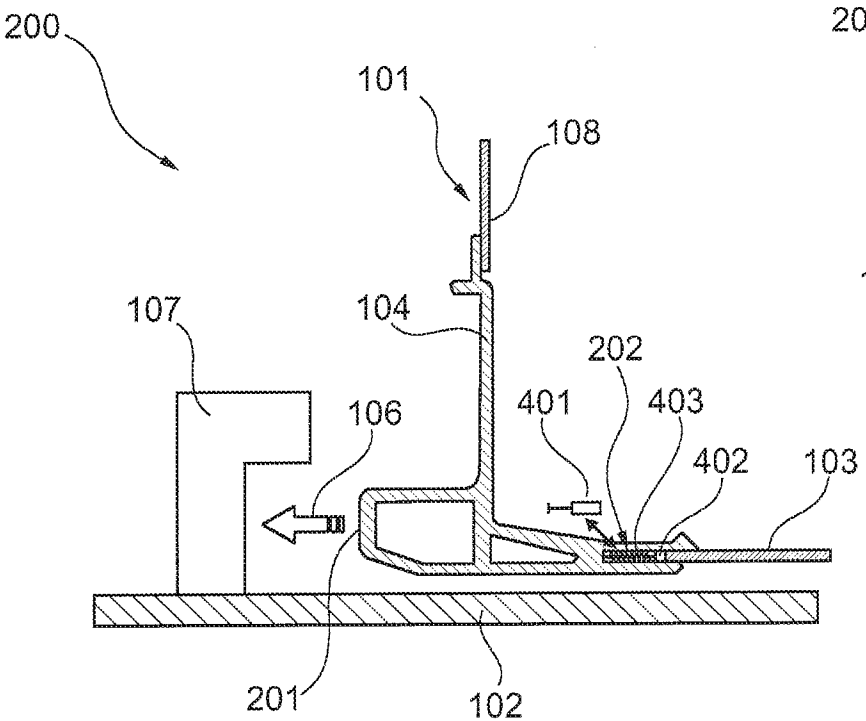
FIG. 4*a* shows a side view of a diagrammatic depiction of a device for reducing loads on a moved cargo unit inside a cargo hold of a transport means according to an exemplary embodiment of the invention.

FIG. 4*a* shows a device 200 for reducing loads on a moved cargo unit 101 inside a cargo hold 102 of a transport means, wherein a vertical lateral wall 108 of the cargo unit 101 is secured to an edge profile 104 of the cargo unit 101. A floor plate 103 of the cargo unit 101 is encased in a groove 402 of the edge profile 104, wherein the groove 402 is designed to float mount the floor plate 103 in the groove 402. The float mounted floor plate 103 can be enabled by a damping unit 202 comprised of a damper 401 and a spring element 403.

The cargo unit 101 moves in a direction of movement 106 toward a latch 107, which is situated inside a cargo hold 102, wherein the damping unit 202 is designed to dampen the movement by the cargo unit 101 in the direction of movement 106 of the cargo unit 101 to reduce the loads placed on the cargo unit 101. The edge profile 104 forms a rail bumper 201 in the direction of the latch 107.

FIG. 4*b* shows the device 200 on FIG. 4*a* as viewed from above. The floor plate 103 can be elastically held in the groove 402 of the edge profile 104. In the case of load impacts, the contribution made by the edge profile 104 is similar to the contribution of the device 200 on FIGS. 3*a* and 3*b*. Decoupling at the junction of the floor plate 103 and edge profile 102 takes place similarly to elastomer damping according to the device 200 on FIGS. 3*a* and 3*b*. The bearing or accommodation of the floor plate 103 in the vertical direction is reduced. Rivets can be used to secure the floor plate 103 to the edge profile 104 in oblong holes.

Figure 5B:
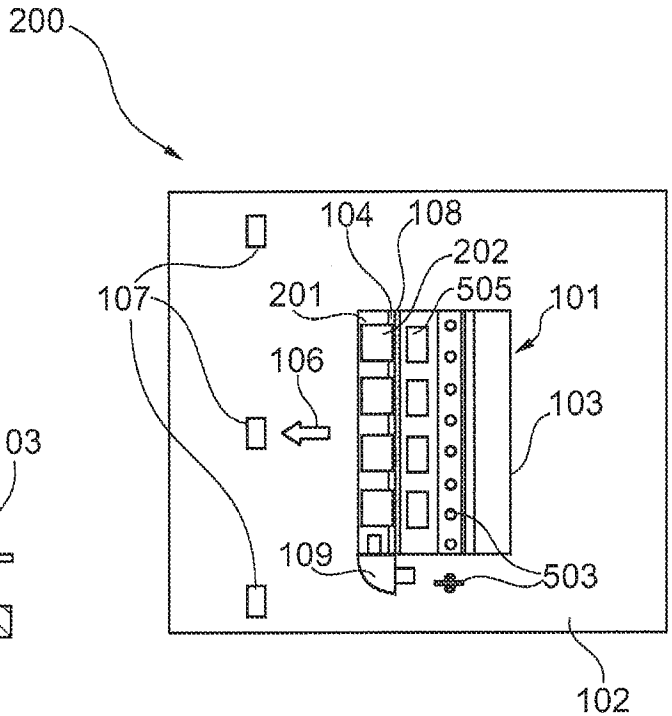
FIG. 5*b* shows the device on FIG. 5*a* as viewed from above.
Figure 5A:
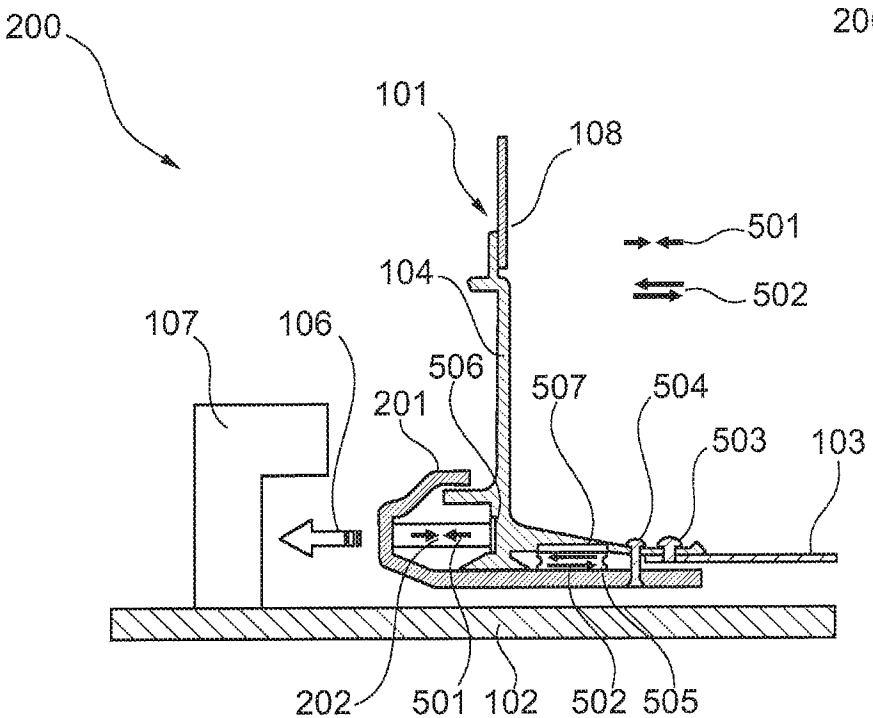
FIG. 5*a* shows a side view of another diagrammatic depiction of a device for reducing loads on a moved cargo unit inside a cargo hold of a transport means according to an exemplary embodiment of the invention.

FIG. 5*a* shows a device 200 for reducing loads on a moved cargo unit 101 inside a cargo hold 102 of a transport means with a latch 107, a cargo hold 102 and a cargo unit 101, which moves in a direction of movement 106 toward the latch 107, according to the device 200 on FIG. 4*a*. A lateral wall 108 of the cargo unit 101 is joined to the floor plate 103 by means of an edge profile 104 and a rivet 503. A first damping unit 202 separating a rail bumper 201 from the edge profile 104 is attached on a vertical side 506 of the edge profile 104. This first damping unit 202 is arranged in the direction of the direction of movement 106 of the rail bumper 201.

A second damping unit 505 is located between the rail bumper 201 and a second side 507 of the edge profile 104, wherein the first side 506 is situated perpendicular to the second side 507. The rail bumper 201 is additionally joined to the edge profile 104 in proximity to the floor plate 103 by means of a rivet 504.

A compressive pressure 501 acts on the first damping element 202, while the second damping element 505 is exposed to shearing forces or shear stress 502.

FIG. 5*b* shows the device 200 on FIG. 5*a* as viewed from above. The first and second damping units 202, 505 can be made out of rubber, and act as a spring directional coupling and a damping element. The rubber material is very well suited for absorbing shearing forces or shear stress 502, and is also suitable for absorbing a compressive pressure 502. By contrast, exposure to tensile forces or tensile stress can be critical with respect to rubber.

The corner unit 109 is designed to join a respective two edge profiles 102 of the four edge profiles 102 of the cargo unit 101.

Figure 6B:
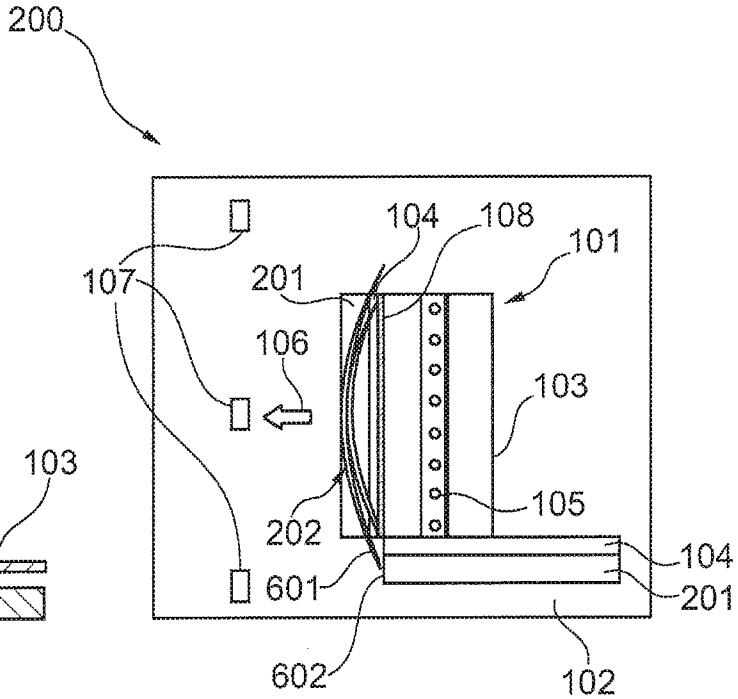
FIG. 6*b* shows the device on FIG. 6*a* as viewed from above.
Figure 6A:
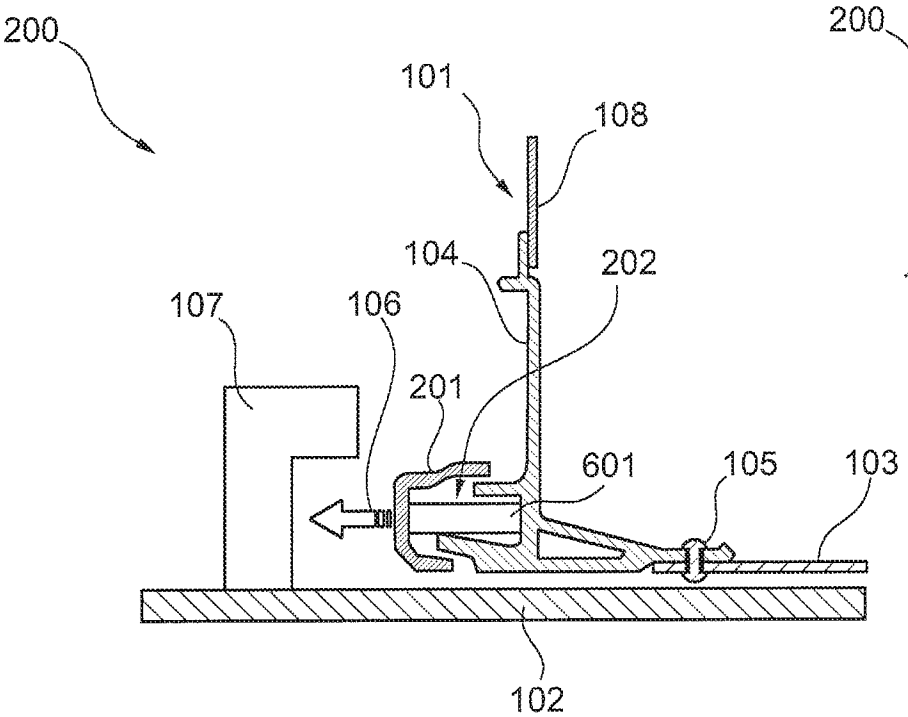
FIG. 6*a* shows a side view of a diagrammatic depiction of a device for reducing loads on a moved cargo unit inside a cargo hold of a transport means according to an exemplary embodiment of the invention.

FIG. 6*a* shows a device 200 for reducing loads on a moved cargo unit 101, which moves inside a cargo hold 102 in a direction of movement 106 toward a latch 107, which is arranged on the cargo hold 102 of a transport means. The cargo unit 101 exhibits a lateral wall 108, which is joined by means of an edge profile 104 with a floor plate 103, which is attached to the edge profile 104 by way of a rivet 105.

The cargo unit 101 further exhibits a rail bumper 201, which is arranged in the direction of movement 106 of a damping unit 202, which can be designed as a leaf spring or flat spiral spring 601, wherein the damping unit 202 is situated between the edge profile 104 and the rail bumper 201.

The damping unit 202 is configured to dampen the movement of the cargo unit 101 in the direction of movement 106 of the cargo unit 101 to reduce the loads placed on the cargo unit 101.

FIG. 6*b* shows the device 200 on FIG. 6*a* as viewed from above. The flat spiral spring 601 here decouples the rail bumper 201 from the edge profile 104. The spring receptacle can be located on the edge profile 104 behind the rail bumper 201 (short flat spiral spring) or on the face of the edge profiles 602 on the left and right side of an edge profile 104.

Figure 7B:
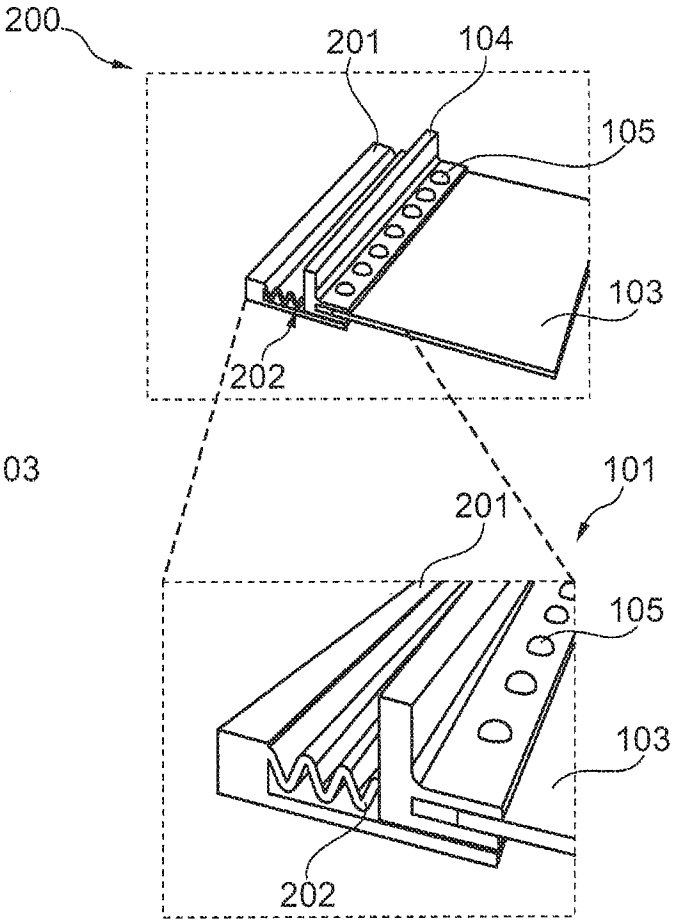
FIG. 7*b* shows the device on FIG. 7*a* as viewed from above.
Figure 7A:
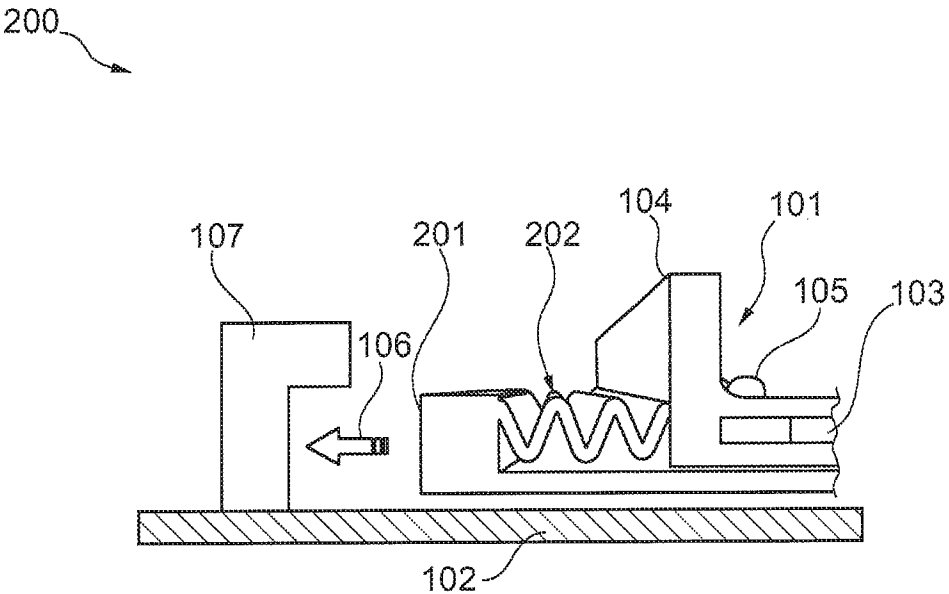
FIG. 7*a* shows a side view of another diagrammatic depiction of a device for reducing loads on a moved cargo unit inside a cargo hold of a transport means according to an exemplary embodiment of the invention.

FIG. 7*a* shows a device 200 for reducing loads on a moved cargo unit 101, which inside a cargo hold 102 of a transport means moves in a direction of movement 106 toward a latch 107 of the cargo hold 102. The cargo unit 101 encompasses an edge profile 104 that accommodates a rail bumper 201, wherein a damping unit 202 is integrated into the rail bumper 201 of the cargo unit 101. A floor plate 103 is joined to the edge profile 104 of the cargo unit 101 by means of a rivet 105.

FIG. 7*b* shows the device 200 on FIG. 7*a* in a perspective view from above, and magnified in a perspective view from above. The damping unit 202 or a spring can be integrated into a section of the edge profile 104 or rail bumper 202, wherein an early decoupling of the floor plate mass can reduce the peak impact mass.

Figure 8B:
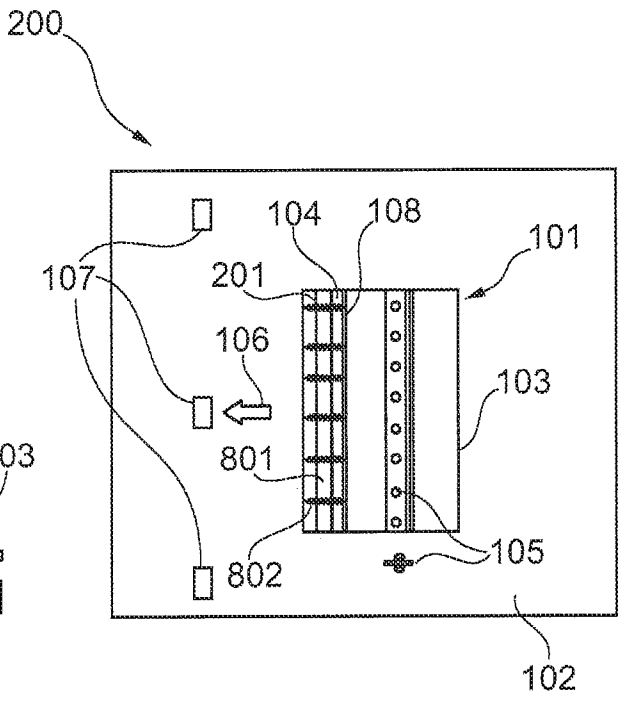
FIG. 8*b* shows the device on FIG. 8*a* as viewed from above.
Figure 8A:
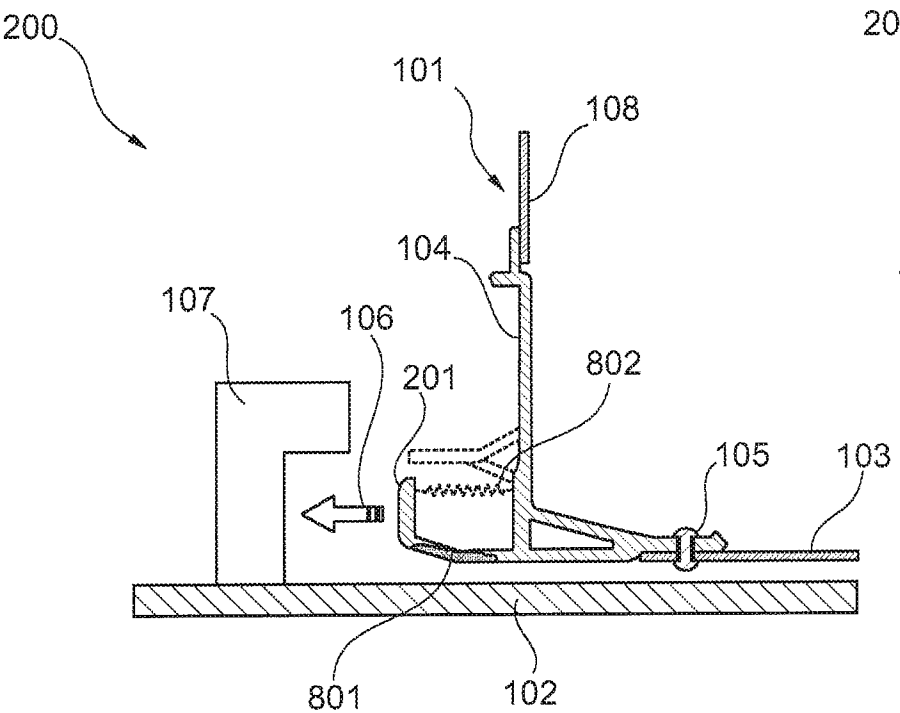
FIG. 8*a* shows a side view of a diagrammatic depiction of a device for reducing loads on a moved cargo unit inside a cargo hold of a transport means according to an exemplary embodiment of the invention.

FIG. 8*a* shows a device 200 for reducing loads on a moved cargo unit 101 in a direction of movement 106 inside a cargo hold 102 of a transport means in the direction of a latch 107 of the cargo hold 102. The cargo unit 101 exhibits a lateral wall 108, which is joined to a floor plate 103 by way of an edge profile 104, wherein the floor plate 103 is secured to the edge profile 104 by means of a rivet 105.

The cargo unit 101 further exhibits a rail bumper 201 joined by an elastic lip 801 with the edge profile 104, wherein the lip 801 acts as a damping unit 202, and is designed to dampen a movement by the cargo unit 101 in a direction of movement 106 of the cargo unit 101 to reduce the loads placed on the cargo unit 101. Along with the lip 801, a spring 802 can be provided as an additional damping element.

FIG. 8*b* shows the device 200 on FIG. 8*a* as viewed from above. The elastic lip 801 can be designed as an aluminum lip (as a single piece with the edge profile 104) or polymer material (insert, inlay) having a defined stiffness/damping, and allows the cargo unit 101 to deform in the direction of the load impact. If the lip 801 is configured as an inlay, the lip 801 can be easily replaced.

Figure 9:
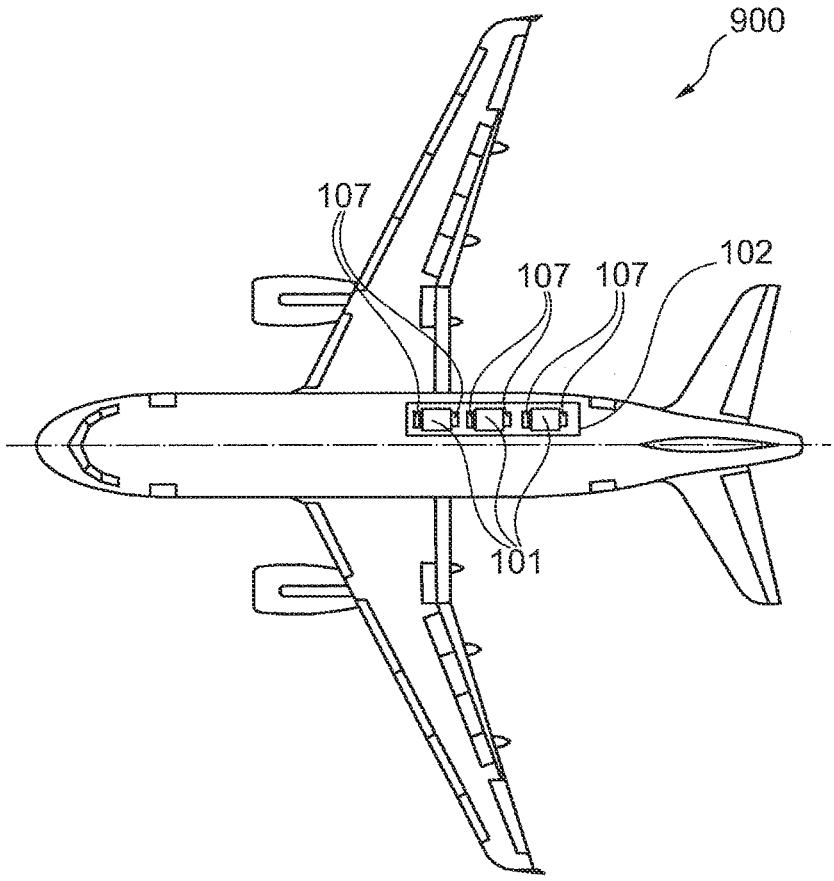
FIG. 9 shows a transport means with a cargo hold, a cargo container and a latch for fixing the cargo container in place according to an exemplary embodiment of the invention.

FIG. 9 shows a transport means 900 with a cargo hold 102, several cargo containers 101, and several latches 107 for fixing the cargo containers 101 in place inside the cargo hold 102.

Figure 10:
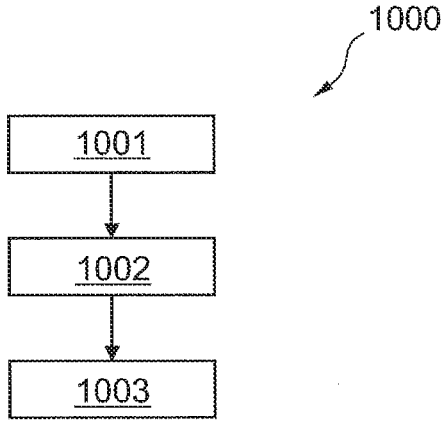
FIG. 10 shows a flowchart of a method for reducing loads on a moved cargo unit inside a cargo hold of a transport means according to an exemplary embodiment of the invention.

FIG. 10 shows a flowchart of a method 1000 for reducing loads on a moved cargo unit inside a cargo hold of a transport means.

The method 1000 involves the following steps: In step 1001, a damping unit is situated between an edge profile and a floor plate of the cargo unit, or between the edge profile and a rail bumper of the cargo unit. In step 1002, a movement by the cargo unit in a direction of movement of the cargo unit is damped to reduce the loads placed on the cargo unit by means of a damping unit. Finally, step 1003 involves reducing the loads on the moved cargo unit during the process of loading the cargo unit, and while transporting the cargo unit inside the cargo hold of the transport means.

Even though the invention was described drawing reference to the exemplary embodiment, various changes and modifications can be introduced without departing from the protective scope of the invention. The transport means with the cargo hold, the cargo container and latch for fixing the cargo container in place can be designed as a surface vehicle, an aircraft, such as an airplane or helicopter, as well as a watercraft and rail vehicle.

In addition, let it be noted that "encompassing", "comprising" or "exhibiting" do not preclude any other elements or steps, and that "one" or "a" do not rule out a plurality. In particular, for example, the device can exhibit more than one floor plate, more than one edge profile, more than one rail bumper, more than a first damping unit, more than a second damping unit, the cargo container cane exhibit more than one lateral wall, and the transport means can exhibit more than one cargo hold, more than one cargo container and more than one latch.

Let it further be noted that features or steps described with reference to one of the above exemplary embodiments can also be used in combination with other features or steps in other exemplary embodiments described above. Reference numbers in the claims are not to be construed as limiting.

The invention claimed is:

1. A device for reducing loads on a moved cargo unit inside a cargo hold of a transport means, wherein the device comprises:

a floor plate of the cargo unit;

an edge profile of the cargo unit;

a rail bumper of the cargo unit;

a first damping unit;

a second damping unit;

wherein the first damping unit is connected to the rail bumper and a first side of the edge profile;

wherein the second damping unit is connected to the rail bumper and a second side of the edge profile;

wherein the first side is arranged perpendicular to the second side; and wherein the first damping unit is adapted for damping a movement of the cargo unit in a direction of movement of the cargo unit parallel to a floor of the cargo hold for reducing the loads placed on the cargo unit.

2. The device of claim 1, wherein the edge profile and rail bumper are configured as separate assemblies.

3. The device of claim 1, wherein the first damping unit comprises an elastic spring element.

4. The device of claim 1, wherein the second damping unit comprises an elastic spring element.

5. The device of claim 1, wherein the first damping unit comprises an elastically deformable rivet joint with an elastically deformable bushing.

6. The device of claim 1, wherein the second damping unit comprises an elastically deformable rivet joint with an elastically deformable bushing.

7. The device of claim 6, wherein the elastically deformable bushing comprises an elastomer.

8. The device of claim 1, wherein the first damping unit is integrated into the rail bumper of the cargo unit.

9. The device of claim 1, wherein the first damping unit comprises an elastic lip;

wherein the elastic lip joins the rail bumper with the edge profile.

10. A device for reducing loads on a moved cargo unit inside a cargo hold of a transport means, wherein the device comprises:

a floor plate of the cargo unit;
an edge profile of the cargo unit;
a rail bumper of the cargo unit;
a first damping unit;
wherein the first damping unit is adapted for damping a movement of the cargo unit in a direction of movement of the cargo unit for reducing the loads placed on the cargo unit,
wherein the edge profile comprises a groove adapted to float mount the floor plate in the groove;
wherein the first damping unit is situated in the groove of the edge profile.

11. A cargo container for an aircraft, wherein the cargo container comprises:
a lateral wall;
a device for reducing loads on a moved cargo unit inside a cargo hold of the aircraft, wherein the device comprises:
a floor plate of the cargo unit;
an edge profile of the cargo unit;
a rail bumper of the cargo unit;
a first damping unit;
a second damping unit;
wherein the first damping unit is connected to the rail bumper and a first side of the edge profile;
wherein the second damping unit is connected to the rail bumper and a second side of the edge profile;
wherein the first side is arranged perpendicular to the second side; and
wherein the first damping unit is adapted for damping a movement of the cargo unit in a direction of movement of the cargo unit parallel to a floor of the cargo hold for reducing the loads placed on the cargo unit; and
wherein the edge profile is configured for joining the lateral wall with the floor plate.

12. A transport means, wherein the transport means comprises:
a cargo hold;
a cargo container for the transport means, wherein the cargo container comprises:
a lateral wall;
a device for reducing loads on a moved cargo unit inside a cargo hold of the aircraft, wherein the device comprises:
a floor plate of the cargo unit;
an edge profile of the cargo unit;
a rail bumper of the cargo unit;
a first damping unit;
a second damping unit;
wherein the first damping unit is connected to the rail bumper and a first side of the edge profile;
wherein the second damping unit is connected to the rail bumper and a second side of the edge profile;
wherein the first side is arranged perpendicular to the second side; and
wherein the first damping unit is adapted for damping a movement of the cargo unit in a direction of movement of the cargo unit parallel to a floor of the cargo hold for reducing the loads placed on the cargo unit;
wherein the edge profile is configured for joining the lateral wall with the floor plate; and
a latch for fixing the cargo container in place inside the cargo hold.

13. A method for reducing loads on a moved cargo unit inside a cargo hold of a transport means, wherein the method comprises the steps of:
connecting a first damping unit to a rail bumper and a first side of an edge profile; connecting a second damping unit to the rail bumper and a second side of the edge profile, wherein the first side is arranged perpendicular to the second side;
damping a movement by the cargo unit in a direction of movement of the cargo unit parallel to a floor of the cargo hold so as to reduce the loads placed on the cargo unit by at least one of the first damping unit and the second damping unit.

14. The method of claim 13, further comprising the following step of:
reducing the loads on the movable cargo unit during a process of loading the cargo unit or while transporting the cargo unit inside the cargo hold of the transport means.

15. A cargo container for an aircraft, wherein the cargo container comprises:
a lateral wall; and
a device for reducing loads on a moved cargo unit inside a cargo hold of the aircraft, wherein the device comprises:
a floor plate of the cargo unit;
an edge profile of the cargo unit;
a rail bumper of the cargo unit;
a first damping unit;
wherein the first damping unit is adapted for damping a movement of the cargo unit in a direction of movement of the cargo unit for reducing the loads placed on the cargo unit,
wherein the edge profile comprises a groove adapted to float mount the floor plate in the groove;
wherein the first damping unit is situated in the groove of the edge profile; and
wherein the edge profile is configured for joining the lateral wall with the floor plate.

* * * * *